US012188666B2

(12) United States Patent
Hirasawa

(10) Patent No.: US 12,188,666 B2
(45) Date of Patent: Jan. 7, 2025

(54) VALVE ARRANGEMENT FOR OUTDOOR UNIT FOR AIR CONDITIONER

(71) Applicant: TOSHIBA CARRIER CORPORATION, Kawasaki (JP)

(72) Inventor: Yuta Hirasawa, Shizuoka (JP)

(73) Assignee: CARRIER JAPAN CORPORATION, Tokyo (JP)

( * ) Notice: Subject to any disclaimer, the term of this patent is extended or adjusted under 35 U.S.C. 154(b) by 0 days.

(21) Appl. No.: 18/245,088

(22) PCT Filed: Sep. 14, 2020

(86) PCT No.: PCT/JP2020/034730
§ 371 (c)(1),
(2) Date: Mar. 13, 2023

(87) PCT Pub. No.: WO2022/054284
PCT Pub. Date: Mar. 17, 2022

(65) Prior Publication Data
US 2023/0366566 A1 Nov. 16, 2023

(51) Int. Cl.
*F24F 1/32* (2011.01)

(52) U.S. Cl.
CPC ..... *F24F 1/32* (2013.01)

(58) Field of Classification Search
CPC ..... F24F 1/32; F24F 1/46
See application file for complete search history.

(56) References Cited

U.S. PATENT DOCUMENTS 8,297,071 B2 * 10/2012 Shioyama ..... F24F 1/32 62/298
2009/0044554 A1 * 2/2009 Takeichi ..... F24F 1/54 251/366
2020/0248912 A1 * 8/2020 Kim ..... F24F 13/0209

FOREIGN PATENT DOCUMENTS

JP S54-022343 U 2/1979
JP 2007-120900 5/2007
KR 2007-0002509 8/2012

OTHER PUBLICATIONS

International Search Report in Application No. PCT/JP2020/034730, dated Nov. 2, 2020.
Chinese Office Action in Application No. 202080105074.5, dated Sep. 29, 2024.

* cited by examiner

*Primary Examiner* — Lionel Nouketcha
(74) *Attorney, Agent, or Firm* — DLA Piper LLP (US)

(57) ABSTRACT

To achieve both improving operability of stop valves and downsizing an outdoor unit, the outdoor unit for an air-conditioner includes a valve fixing frame provided on the base frame, and a plurality of stop valves fixed to the valve fixing frame. A beam of the valve fixing frame includes a first notch opened upward, in which a first stop valve is disposed therein, and a second notch opened downward, in which a second stop valve is disposed therein. The first stop valve and the second stop valve are different in installation height in a vertical direction with reference to the installation surface.

4 Claims, 6 Drawing Sheets

VALVE ARRANGEMENT FOR OUTDOOR UNIT FOR AIR CONDITIONER

CROSS REFERENCE TO RELATED APPLICATIONS

This application claims the benefit of priority of No. PCT/JP2020/034730, filed on Sep. 14, 2020, the entire contents of which are incorporated herein by reference.

TECHNICAL FIELD

Embodiments of the present invention relate to an outdoor unit for an air conditioner.

BACKGROUND

An air conditioner includes an indoor unit, an outdoor unit, and a plurality of crossover pipes that allow a refrigerant to flow between the indoor unit and the outdoor unit.

The outdoor unit includes: a plurality of stop valves that connect the plurality of crossover pipes to refrigerant piping inside the outdoor unit; and a stop-valve support member that is formed in plate shape and supports the plurality of stop valves.

The conventional stop-valve support member supports two stop valves side by side at the same height position. In other words, in the conventional outdoor unit, two stop valves overlap when viewed in the horizontal direction.

PRIOR ART DOCUMENT

Patent Document

[Patent Document 1] JP 2007-120900 A

SUMMARY

Problems to be Solved by Invention

When two stop valves are disposed at the same height position as in the conventional outdoor unit, the operability of the stop valves is deteriorated. The operation of the stop valves includes: an opening/closing operation of an operation port to be opened at the time of performing an opening/closing operation of a valve body; and an opening/closing operation of a service port to be opened at a filling of the refrigerant and/or an evacuation of the refrigerant piping, for example. The operator loosens a flare nut with a tool so as to open the port, and tightens the flare nut with the tool so as to close the port. The tool is, for example, a wrench. When the two stop valves are disposed at the same height position, there is a high possibility that the tool interferes with the stop valve next to the stop valve being operated. If the tool interferes with the adjacent stop valve, the operability of the port is inevitably deteriorated.

The operability of a control valve can be readily improved by sufficiently widening the interval between adjacent stop valves. However, simply widening the interval between adjacent stop valves requires a larger volume for disposing the plurality of stop valves inside the outdoor unit, which hinders downsizing of the outdoor unit.

Thus, an object of the present invention is to provide an air-conditioner outdoor unit that can achieve both improving operability of stop valves and downsizing the outdoor unit.

Means for Solving Problem

To solve the above-mentioned problem, an outdoor unit for an air-conditioner according to embodiments of the present invention includes a base frame installed in parallel with an installation surface, a valve fixing frame provided on the base frame, and a plurality of stop valves fixed to the valve fixing frame. The valve fixing frame includes a pair of pillars extending substantially vertically upward from the base frame, and a beam extending across the pair of pillars to support the plurality of stop valves. The beam includes a first straight portion that has a first notch and a second notch. The first notch is opened upward, and a first stop valve included in the plurality of stop valves is disposed therein. The second notch is opened downward, and a second stop valve included in the plurality of stop valves is disposed therein. The first stop valve and the second stop valve are different in installation height in a vertical direction with reference to the installation surface.

Preferably, the outdoor unit for an air-conditioner further includes a protrusion provided on an edge of an open end of the second notch to support the second stop valve from below.

Preferably, the protrusion protrudes horizontally or obliquely upward in a situation where the outdoor unit is installed on a horizontal installation surface.

Preferably, the beam further includes a second straight portion that forms an obtuse angle with the first straight portion in plan view, and the second straight portion supports a third stop valve included in the plurality of stop valves.

Effects of Invention

According to embodiments of the present invention, an air-conditioner outdoor unit capable of improving operability of stop valves and downsizing the outdoor unit can be provided.

DETAILED DESCRIPTION

Embodiments of an outdoor unit for an air conditioner according to the present invention will now be described by referring to FIG. 1 to FIG. 6. The same reference signs are given to identical or equivalent components in each figure.

Figure 1:
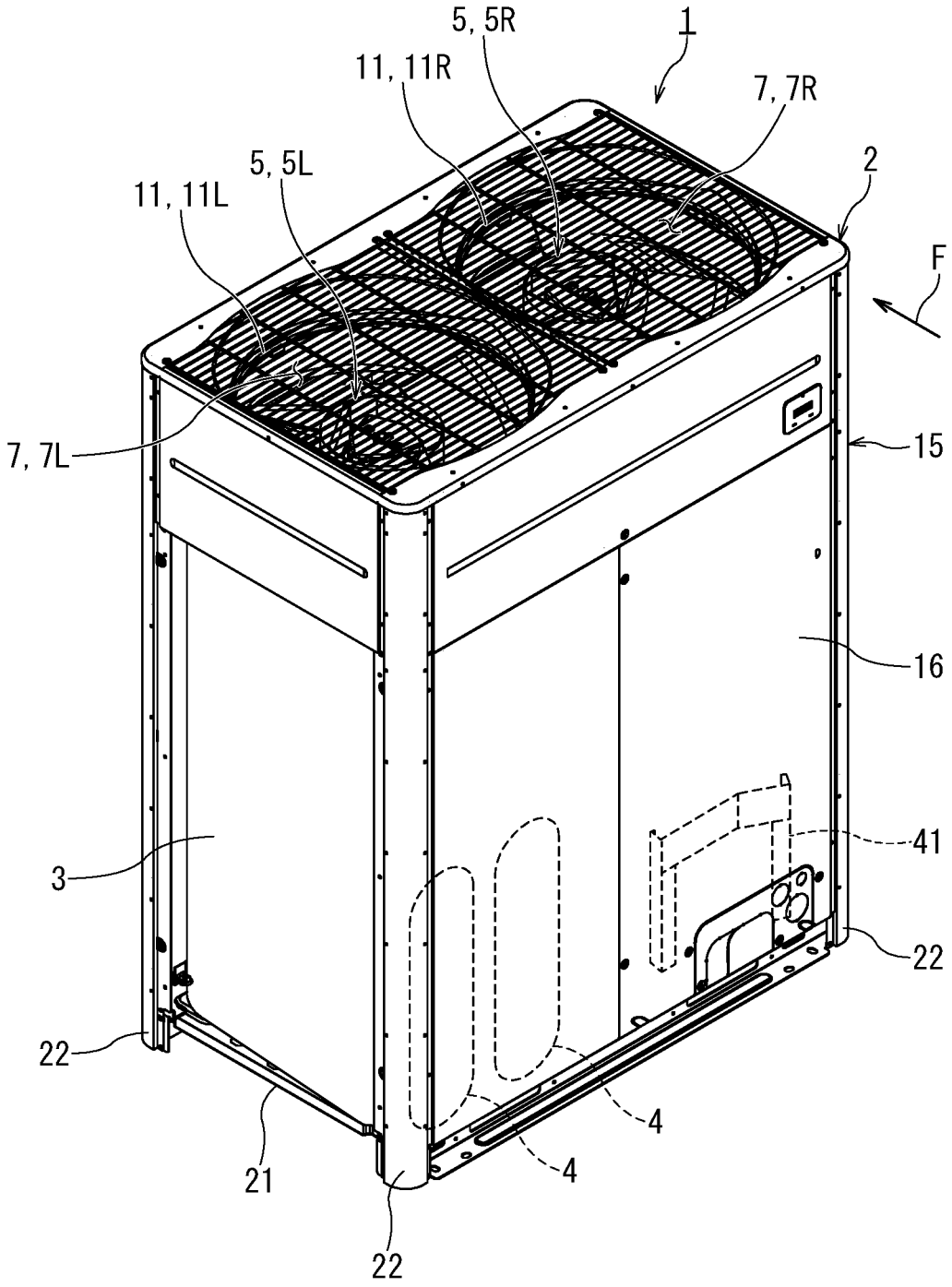
FIG. 1 is a perspective view of an outdoor unit for an air conditioner according to one embodiment of the present invention.

FIG. 1 is a perspective view of an outdoor unit for an air conditioner according to one embodiment of the present invention.

As shown in FIG. 1, the air conditioner according to the present embodiment includes an outdoor unit 1 and an indoor unit (not shown). The installation location of the indoor unit is inside a room of a building. The installation location of the outdoor unit 1 is outside the building. The outdoor unit 1 is installed on a substantially horizontal foundation, i.e., on an installation surface. The indoor unit is installed by being embedded in an indoor ceiling or by being suspended from a ceiling and/or beams.

The air conditioner also includes a refrigeration cycle (not shown). The refrigeration cycle includes: heat exchangers 3 on a heat source side; compressors 4; another heat exchanger (not shown) on a utilization side; an expansion valve (not shown); and refrigerant piping (not shown) that circulates the refrigerant through these components. The refrigeration cycle may include a four-way valve (not shown) that switches between a cooling operation and a heating operation of the air conditioner.

Further, the air conditioner may be of simultaneous heating/cooling operation type. The air conditioner of simultaneous heating/cooling operation type includes: a plurality of indoor units; at least one outdoor unit; and a plurality of crossover pipes that allow the refrigerant to flow between the plurality of indoor units and the at least one outdoor unit. The plurality of crossover pipes include: a high-pressure gas pipe that circulates a high-pressure gas refrigerant discharged from the compressors 4; a liquid pipe that circulates a liquid refrigerant condensed in the heat exchangers 3 on the heat-source side; and a low-pressure gas pipe that circulates a low-pressure gas refrigerant having been subjected to heat-exchange in the heat exchanger on the utilization side to the compressors 4.

The outdoor unit 1 accommodates the heat exchangers 3 on the heat-source side of the refrigeration cycle, the compressors 4, and the four-way valve. The indoor unit accommodates the heat exchanger on the utilization side of the refrigeration cycle. The expansion valve may be accommodated in the indoor unit or may be accommodated in the outdoor unit. Moreover, the expansion valve may be provided in both the indoor unit and the outdoor unit.

The outdoor unit and the indoor unit are connected via crossover pipes (not shown). The crossover pipes are part of the refrigerant piping. The air conditioner conditions the indoor air by circulating the refrigerant between the heat exchangers 3 on the side of the outdoor unit 1 and the heat exchanger on side of the indoor unit.

Figure 2:
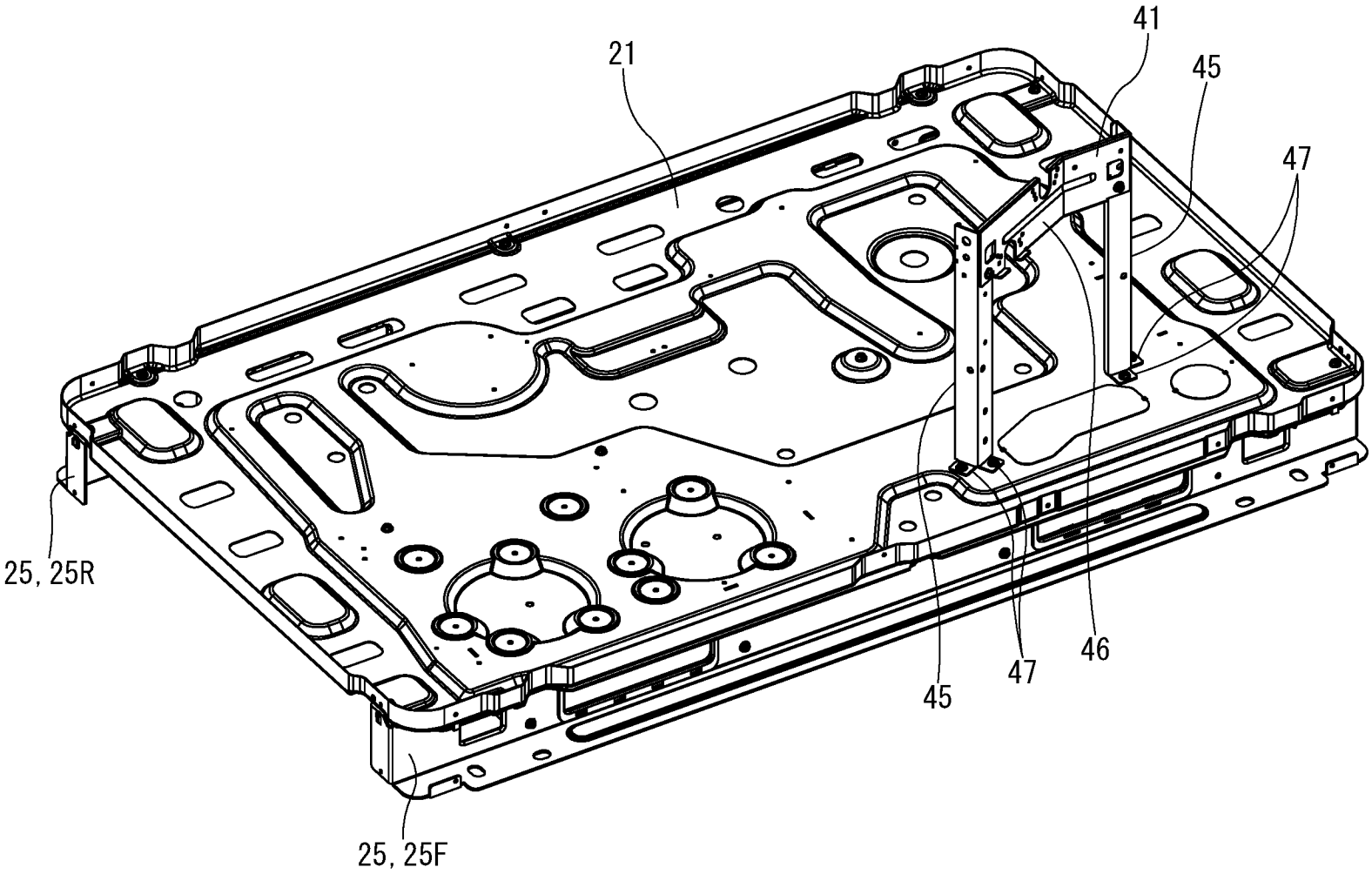
FIG. 2 is a perspective view of a valve fixing frame and a base frame of the outdoor unit for the air conditioner according to the embodiment of the present invention.

FIG. 2 is a perspective view of a valve fixing frame and a base frame of the outdoor unit for the air conditioner according to the embodiment of the present invention.

As shown in FIG. 2 in addition to FIG. 1, the outdoor unit 1 for the air conditioner according to the present embodiment includes a rectangular parallelepiped housing 2 that is smaller in the width dimension than in the height dimension and is smaller in the depth dimension than in the width dimension.

Inside the housing 2, the heat exchangers 3, the compressors 4, an air blower 5, and the like are accommodated.

The housing 2 includes a frame 15 and an outer plate 16 that covers the front of the frame 15.

The frame 15 is an assembly of a plurality of members that are sheet metal processed products of steel plates. Each member is joined by screwing and/or welding. The frame 15 includes: a base frame 21 that is disposed on the bottom surface of the housing 2; four pillars 22 that extend upward from the respective four corners of the base frame 21; and four beams (not shown), each of which is bridged across adjacent pillars 22.

The base frame 21 is a sheet metal processed product of a steel plate. The heat exchangers 3 and the compressors 4 are mounted on the top surface of the base frame 21. The bottom surface of the base frame 21 is provided with a plurality of stringers 25 that extend in parallel with the installation surface and are arranged in parallel crosses. The plurality of stringers 25 include: a front stringer 25F extending along the front surface of the housing 2; a rear stringer 25R extending along the back surface of the housing 2; and a plurality of vertical stringers (not shown) bridged across the front stringer 25F and the rear stringer 25R. The front stringer 25F and the rear stringer 25R extend in parallel. The left end of the front stringer 25F corresponds to the left front corner in the bottom portion of the housing 2, and the right end of the front stringer 25F corresponds to the right front corner in the bottom portion of the housing 2. The left end of the rear stringer 25R corresponds to the left rear corner in the bottom portion of the housing 2, and the right end of the rear stringer 25R corresponds to the right rear corner in the bottom portion of the housing 2.

The four pillars 22 extend in parallel with each other. The four pillars 22 have substantially the same length dimension. The length of each pillar 22 corresponds to the height of the housing 2.

The outer plate 16 covers the front of the housing 2, i.e., the side surface in the front, and is appropriately divided in the same plane. The outer plate 16 contains a plurality of members that are sheet metal processed products of steel plates, and the respective members are screwed to the frame 15. The back surface, the left side surface, and the right side surface of the housing 2 have openings, through which the heat exchangers 3 are exposed.

A pair of outlets 11 (11L, 11R) are disposed on the upper surface of the housing 2 so as to line up on the right and left. In the upper portion of the housing 2, a pair of blowers 5 (5L, 5R) respectively facing the pair of outlets 11 are provided. The pair of blowers 5 are provided inside the housing 2 and disposed above the heat exchangers 3.

The heat exchangers 3 accommodated in the outdoor unit 1 are along the back surface, the left side surface, and the right side surface of the housing 2 surrounded by the pillars 22. The heat exchangers 3 include two heat exchangers that are disposed on the respective right and left sides inside the housing 2, and each heat exchanger is a plate-shaped heat exchanger formed in a square bracket shape (not shown) in plan view of the housing 2. An opening of each heat exchanger in the square bracket shape faces the outer plate 16, which is the front of the housing 2. Thus, the outside air is taken into the housing 2 by the operation of the blower 5 through the heat exchangers, which are exposed through the openings of the back surface, the left side surface, and the right side surface of the housing 2, and then is discharged to the outside of the housing 2 from the outlets 11.

Figure 3:
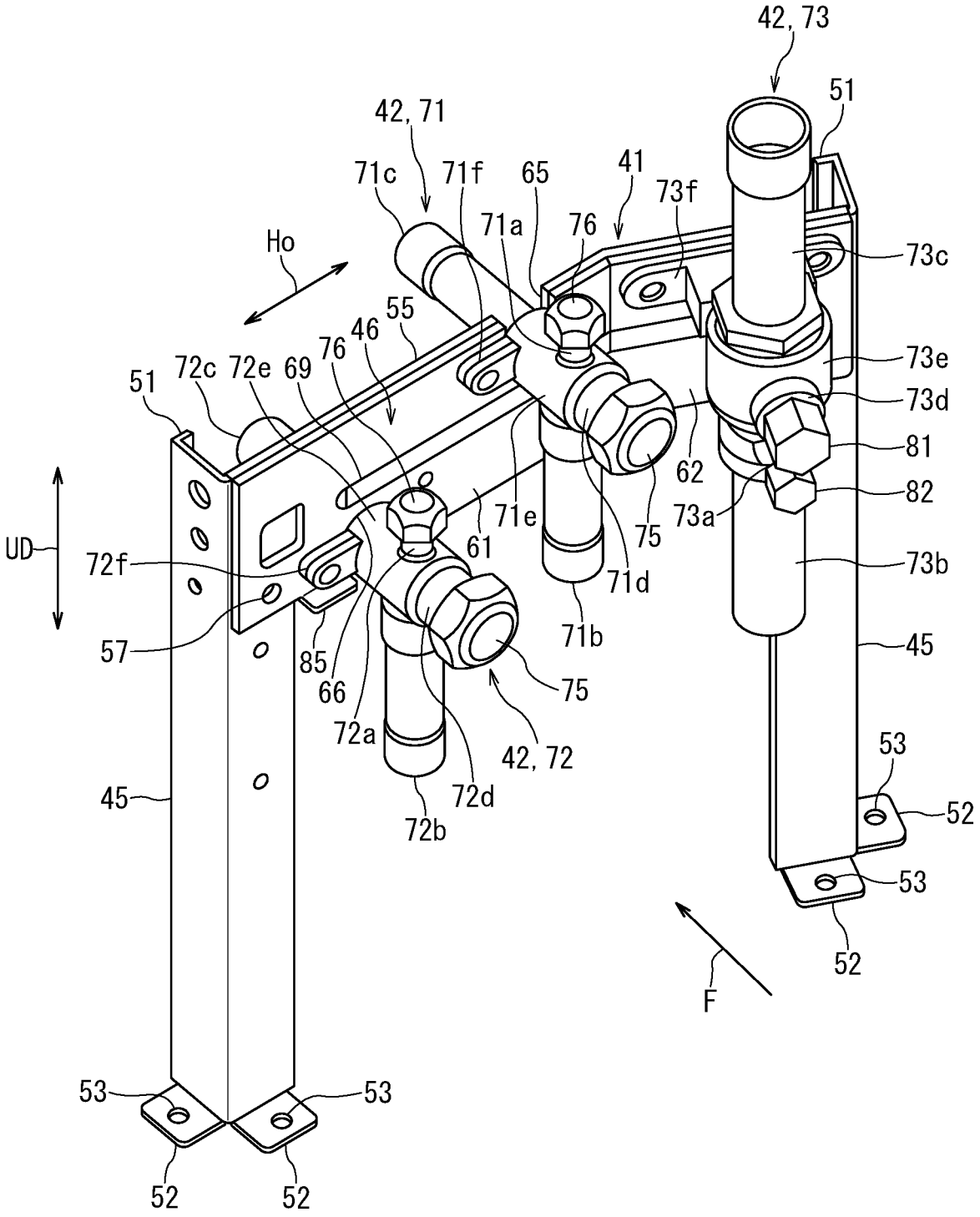
FIG. 3 is a perspective view of the valve fixing frame and a plurality of stop valves of the outdoor unit according to the embodiment of the present invention.

FIG. 3 is a perspective view of the valve fixing frame and the plurality of stop valves of the outdoor unit according to the embodiment of the present invention.

Figure 4:
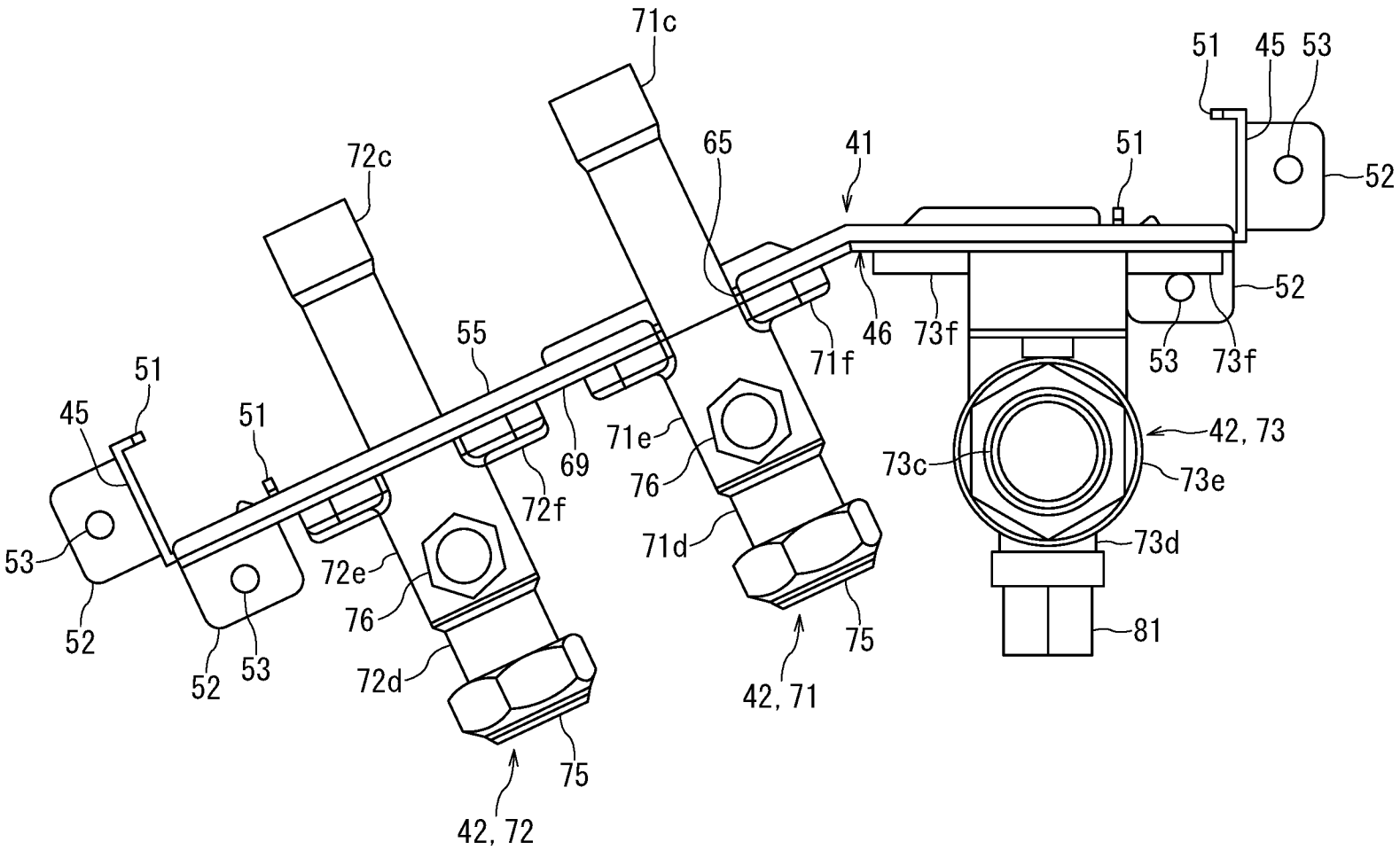
FIG. 4 is a plan view of the valve fixing frame and the plurality of stop valves of the outdoor unit according to the embodiment of the present invention.

FIG. 4 is a plan view of the valve fixing frame and the plurality of stop valves of the outdoor unit according to the embodiment of the present invention.

Figure 5:
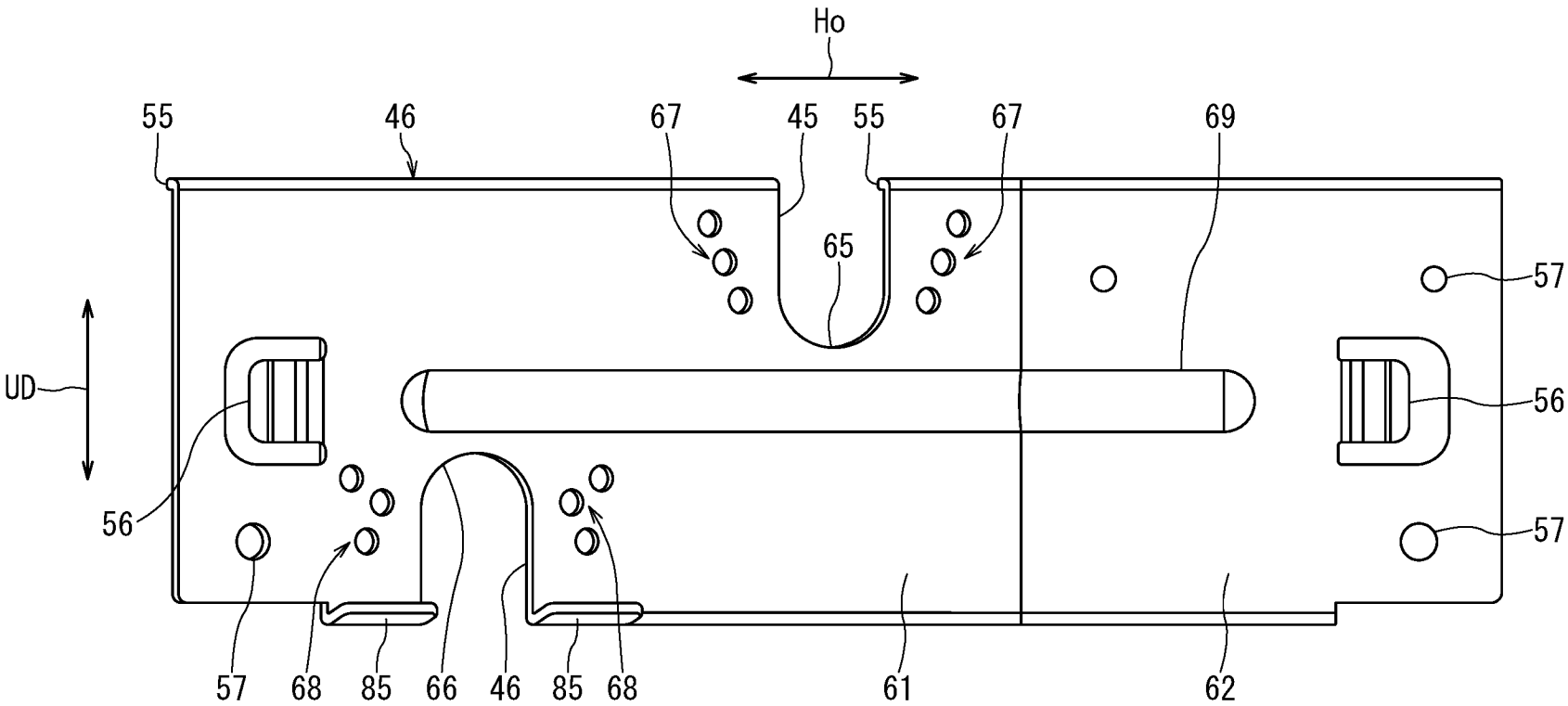
FIG. 5 is a front view of the valve fixing frame of the outdoor unit according to the embodiment of the present invention.

FIG. 5 is a front view of the valve fixing frame of the outdoor unit according to the embodiment of the present invention.

Figure 6:
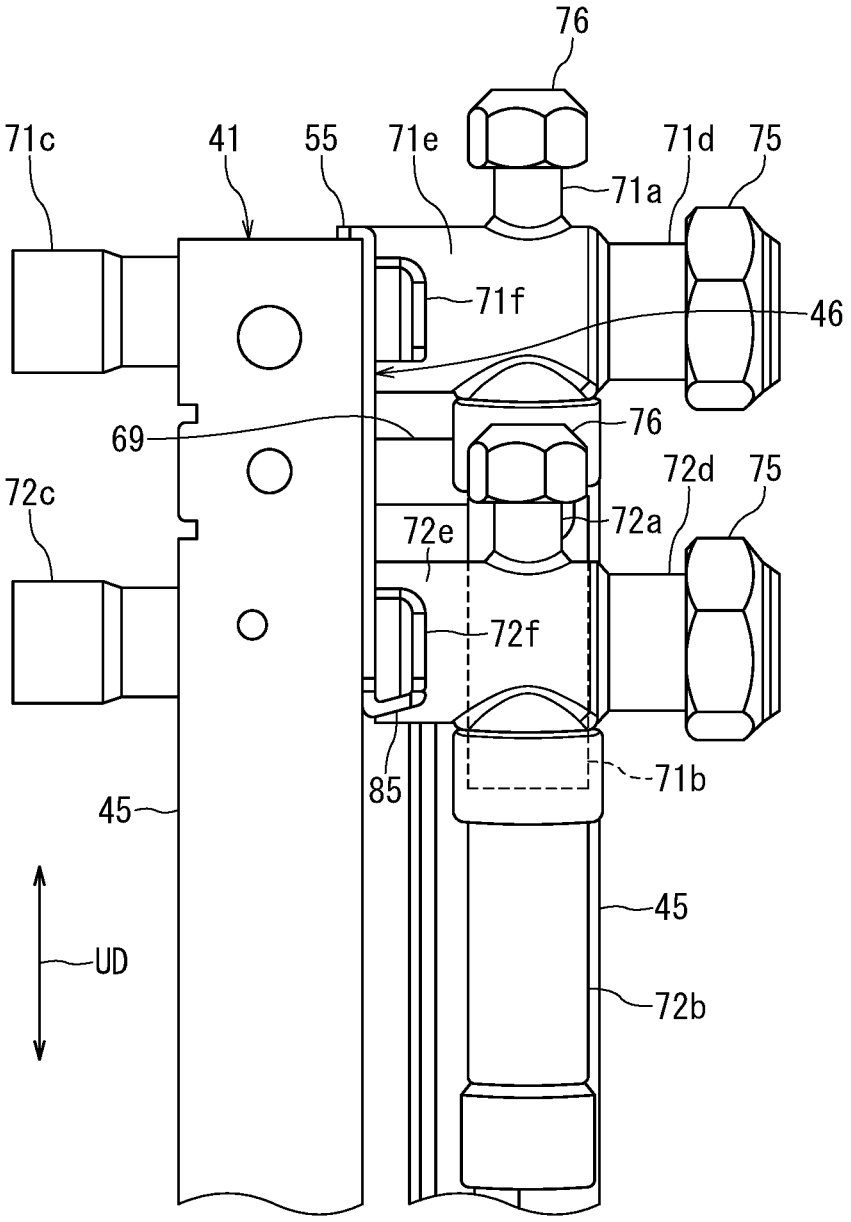
FIG. 6 is a side view of the valve fixing frame and the plurality of stop valves of the outdoor unit according to the embodiment of the present invention.

FIG. 6 is a side view of the valve fixing frame and the plurality of stop valves of the outdoor unit according to the embodiment of the present invention.

As shown in FIG. 3 to FIG. 6, the outdoor unit 1 according to the present embodiment includes: a valve fixing frame 41 provided in the base frame 21; and a plurality of stop valves 42 fixed to the valve fixing frame 41.

The valve fixing frame 41 is disposed on the front of the housing 2, i.e., in the vicinity of the outer plate 16. The valve fixing frame 41 is disposed in the right front corner of the housing 2. The valve fixing frame 41 supports the plurality of stop valves 42 towards the front side of the housing 2.

The plurality of stop valves 42 are also called packed valves. When the outer plate 16 of the housing 2 is partially detached, the plurality of stop valves 42 are exposed to such an extent that the stop valves 42 can be manipulated. In other words, the outer plate 16 of the housing 2 is partially detached at the time of operating the plurality of stop valves 42 accommodated in the outdoor unit 1.

The valve fixing frame 41 includes: a pair of pillars 45 that substantially vertically stand from the base frame 21 of the housing 2; and a beam 46 that is bridged across the pair of pillars 45 and supports the plurality of stop valves 42.

The pair of pillars 45 are sheet metal processed products of steel plates. The cross-sectional shape of each pillar 45 is substantially L-shaped. The end portion of each L-shape is provided with a reinforcing rib 51 that extends over the entire length of the pillar 45. The lower end portion of each pillar 45 is provided with a plurality of flanges 52 that fix the pillar 45 to the base frame 21. Each flange 52 is formed by a bending process, and protrudes toward the outside of the pillar 45. Each flange 52 has a hole 53 through which a screw 47 (FIG. 2) for fixing the pillar 45 to the base frame 21 is inserted.

The beam 46 is a sheet metal processed product of a steel plate. The principal surface of the beam 46 is oriented horizontally. The beam 46 has a rectangular shape extending between the pair of pillars 45. The beam 46 has long sides between the pair of pillars 45 and short sides in the longitudinal direction of each pillar 45. A reinforcing rib 55 extending between the pair of pillars 45 is provided on the upper long side of the beam 46. Each short side of the beam 46 is provided with: a tongue-shaped piece 56 formed by a slitting process (notching); and a hole 57 through which a screw is inserted.

The tongue-shaped pieces 56 are inserted into the respective pillars 45. The beam 46 and the pillars 45 are integrated by: the tongue-shaped pieces 56 inserted into the beam 46; and screws (not shown) tightened to the pillars 45 through the holes 57.

The beam 46 further includes: a first straight portion 61 extending in the longitudinal direction of the beam 46; and a second straight portion 62 extending in the longitudinal direction of the beam 46. The first straight portion 61 and the second straight portion 62 form an obtuse angle in plan view. The first straight portion 61 is connected to one of the pillars 45 and the second straight portion 62 is connected to the other pillar 45.

The first straight portion 61 includes: a first notch 65 which is opened upward and receives therein a first stop valve 71 included in the plurality of stop valves 42; and a second notch 66 which is opened downward and receives therein a second stop valve 72 included in the plurality of stop valves 42. In the first straight portion 61, the first stop valve 71 and the second stop valve 72 are different in installation height in the vertical direction with reference to the installation surface of the housing 2 (solid arrow UD in FIG. 3).

The upwardly-opened first notch 65 is disposed in the central portion in the width direction of the beam 46, near the second straight portion 62. A plurality of screw holes 67 for fixing the first stop valve 71 are provided on both sides of the first notch 65. The plurality of screw holes 67 have a plurality of pairs with different spacings so as to conform to different specifications of the first stop valve 71.

The downwardly-opened second notch 66 is disposed between the first notch 65 and one of the pillars 45. On both sides of the second notch 66, a plurality of screw holes 68 for fixing the second stop valve 72 are provided. The plurality of screw holes 68 have a plurality of pairs with different spacings so as to conform to different specifications of the second stop valve 72.

The second straight portion 62 supports a third stop valve 73 included in the plurality of stop valves 42. Thus, the stop valves 42 (i.e., the first stop valve 71 and the second stop valve 72) of the first straight portion 61 and the third stop valve 73 are offset in the normal direction of the principal surface of the first straight portion 61.

Further, the beam 46 has a convex portion 69 that extends in the longitudinal direction of the beam 46 from the vicinity of one of the tongue-shaped pieces 56 toward the vicinity of the other tongue-shaped piece 56. The convex portion 69 is provided on the principal surface of the beam 46. The convex portion 69 extends in the horizontal direction (solid arrow Ho in FIG. 3) in a situation where the housing 2 is installed on a horizontal ground plane. The convex portion 69 is formed by a stretching process to extend from the first straight portion 61 to the second straight portion 62. The first notch 65 is provided above the convex portion 69, and the second notch 66 is provided below the convex portion 69.

The first stop valve 71 connects the liquid pipe, through which the liquid refrigerant condensed in the heat exchangers 3 on the heat-source side flows, to the refrigerant piping in the outdoor unit 1.

The first stop valve 71 includes: a service port 71*a* for filling the refrigerant piping with the refrigerant and evacuating the inside of the refrigerant piping; an indoor-unit-side connection port 71*b* connected to the crossover pipes; an outdoor-unit-side connection port 71*c* connected to the refrigerant piping in the outdoor unit 1; a valve body (not shown) configured to be opened and closed between the indoor-unit-side connection port 71*b* and the outdoor-unit-side connection port 71*c*; and an operation port 71*d* operable to be opened when the opening or closing operation of the valve body is performed. These ports 71*a*, 71*b*, 71*c*, and 71*d* are arranged in a cross shape.

The outdoor-unit-side connection port 71*c* extends through the beam 46 from its front side to its rear side. The outdoor-unit-side connection port 71*c* and the refrigerant piping in the outdoor unit 1 are joined by, for example, brazing.

The operation port 71*d* is disposed on the extension line of the outdoor-unit-side connection port 71*c* and at the forefront of the first stop valve 71. A cap 75 is tightened on the operation port 71*d*.

The service port 71*a* is connected to the upper end of the portion corresponding to a valve casing 71*e* that accommodates the valve body, and protrudes upward. A cap 76 is tightened on the service port 71*a*. The cap 76 seals the service port 71*a*.

The indoor-unit-side connection port 71*b* is connected to the lower end of the portion corresponding to the valve casing 71*e*, and hangs downward. The indoor-unit-side connection port 71*b* and the crossover pipes are joined at an installation site by, for example, brazing.

The base of the portion corresponding to the valve casing 71*e*, which is adjacent to the outdoor-unit-side connection port 71*c*, is provided with a brim portion 71*f* that protrudes in the longitudinal direction of the beam 46 and is fixed to the beam 46.

The second stop valve 72 connects the high-pressure gas pipe, through which the high-pressure gas refrigerant discharged from the compressor flows, to the refrigerant piping inside the outdoor unit 1. The second stop valve 72 has substantially the same configuration as the first stop valve 71, and its detailed description is omitted.

The service port 71*a* of the first stop valve 71 disposed in the first notch 65 and the service port 72*a* of the second stop valve 72 disposed in the second notch 66 are offset in the vertical direction of the housing 2, and do not overlap each other in side view of the valve fixing frame 41 (i.e., when viewed in the horizontal direction or when viewed in the longitudinal direction of the beam 46 along the principal surface). Additionally, the operation port 71*d* of the first stop valve 71 and the operation port 72*d* of the second stop valve 72 are offset in the vertical direction of the housing 2, and do not overlap each other in side view of the valve fixing frame 41 (i.e., when viewed in the horizontal direction or when viewed in the longitudinal direction of the beam 46 along the principal surface).

The disposition of the first notch 65 and the second notch 66 in the longitudinal direction of the beam 46 may be interchanged. Either of the first stop valve 71 or the second stop valve 72 may be disposed in the first notch 65 or the second notch 66. In addition, the other may be disposed in the second notch 66 or the first notch 65.

The third stop valve 73 connects the low-pressure gas pipe, through which the low-pressure gas refrigerant having been subjected to heat exchange in the heat exchanger on the utilization side flows to the compressor, to the refrigerant piping in the outdoor unit 1.

The third stop valve 73 includes: a service port 73*a* for filling the refrigerant piping with the refrigerant and evacuating the inside of the refrigerant piping; an indoor-unit-side connection port 73*b* connected to the crossover pipes; an outdoor-unit-side connection port 73*c* connected to the refrigerant piping in the outdoor unit 1; a valve body (not shown) configured to be opened and closed between the indoor-unit-side connection port 73*b* and the outdoor-unit-side connection port 73*c*; and an operation port 73*d* that is operated when the opening or closing operation of the valve body is performed.

The outdoor-unit-side connection port 73*c* is connected to the upper end of the portion corresponding to the valve casing 73*e* that accommodates the valve body, and extends upward. The indoor-unit-side connection port 73*b* is connected to the lower end of the portion corresponding to the valve casing 73*e*, and hangs downward. The outdoor-unit-side connection port 73*c* and the refrigerant piping in the outdoor unit 1 are joined by, for example, brazing. The indoor-unit-side connection port 73*b* and the crossover pipes are joined at the installation site by, for example, brazing.

The operation port 73*d* protrudes toward the front from the portion corresponding to the valve casing 73*e*. A cap 81 is tightened on the operation port 73*d*.

The service port 73*a* is disposed below the operation port 73*d* and protrudes toward the front from the portion corresponding to the valve casing 73*e*. A cap 82 is tightened on the service port 73*a*. The cap 82 seals the service port 73*a*.

Of the base of the portion corresponding to the valve casing 73*e*, the part adjacent to the outdoor-unit-side connection port 73*c* is provided with a brim portion 73*f* that protrudes in the longitudinal direction of the beam 46 and is fixed to the beam 46.

The beam 46 includes protrusions 85 that are provided on the edge of the open end of the second notch 66 and support the second stop valve 72 from below. The protrusions 85 are a pair of bent portions provided on both sides of the open end of the second notch 66. The protrusions 85 are formed by bending the lower side portion of the beam 46 by a bending process. The protrusions 85 protrude horizontally or obliquely upward in a situation where the outdoor unit 1 is installed on a horizontal installation surface. In other words, the angle formed by the upper surface of each protrusion 85 and the principal surface of the beam 46 is 90 degrees or less.

As described above, the valve fixing frame 41 of the outdoor unit 1 according to the present embodiment includes: the pair of pillars 45 that substantially vertically stand from the base frame 21; and the beam 46 that is bridged across the pair of pillars 45 and supports the plurality of stop valves 42. The beam 46 includes: the upwardly-opened first notch 65 in which the first stop valve 71 is disposed; and the downwardly-opened second notch 66 in which the second stop valve 72 is disposed, and the respective installation heights of the first stop valve 71 and second stop valve 72 with reference to the installation surface are different in the vertical direction. Thus, in the outdoor unit 1, the service port 71*a* of the first stop valve 71 and the service port 72*a* of the second stop valve 72 are offset in the vertical direction, and the operation port 71*d* of the first stop valve 71 and the operation port 72*d* of the second stop valve 72 are offset in the vertical direction. Hence, the tool does not interfere with the stop valve 42 adjacent to the stop valve 42 to be operated, and the operability of each stop valve 42 is improved. In addition, the outdoor unit 1 has the first stop valve 71 and the second stop valve 72 offset to each other in the vertical direction, which results in achieving both improvement in operability of the stop valves 42 and shortening of the distance between the first stop valve 71 and the second stop valve 72 in the horizontal direction. The outdoor unit 1 reduces the width dimension or depth dimension of the housing 2 by shortening the horizontal distance between the first stop valve 71 and the second stop valve 72, and thereby reduces the installation area of the housing 2.

In addition, the valve fixing frame 41 of the outdoor unit 1 according to the present embodiment has the protrusions 85 that are provided on the edge of the open end of the downwardly-opened second notch 66 to support the second stop valve 72 from below. Thus, in the upwardly-opened first notch 65, the first stop valve 71 is temporarily installed by being hooked on the first notch 65 and then is securely fixed to the valve fixing frame 41. In the downwardly-opened second notch 66, the second stop valve 72 is temporarily installed by being hooked on the protrusions 85 and then is securely fixed to the valve fixing frame 41. Hence, the outdoor unit 1 eliminates the difficulty of installing the second stop valve 72 in the downwardly-opened second notch 66, and can prevent deterioration of maneuverability.

Further, the valve fixing frame 41 of the outdoor unit 1 according to the present embodiment has the protrusions 85 that protrude horizontally or obliquely upward in the case of being installed on a horizontal installation surface. The protrusions 85 protruding horizontally or obliquely upward prevent the second stop valve 72 being caught at the protrusions 85 from falling off, and support the second stop valve 72 so as to press it against the beam 46. Accordingly, the outdoor unit 1 more reliably eliminates the difficulty of installing the second stop valve 72 in the downwardly-opened second notch 66, and thus can sufficiently prevent the deterioration of maneuverability.

Moreover, the valve fixing frame 41 of the outdoor unit 1 according to the present embodiment has the first straight portion 61 and the second straight portion 62, both of which form an obtuse angle in plan view. The second straight portion 62 supports the third stop valve 73. Hence, even in the case of being provided with three stop valves 42 corresponding to three crossover pipes like an air conditioner of simultaneous heating/cooling operation type, the outdoor unit 1 shortens the distance in the horizontal direction between the first stop valve 71, the second stop valve 72, and the third stop valve 73, and can reduce the installation area of the housing 2. Furthermore, in the outdoor unit 1, the third stop valve 73 installed in the second straight portion 62 is offset in the normal direction of the first straight portion 61. Thus, the tool does not interfere with the stop valve 42 adjacent to the stop valve 42 to be operated, and the operability of each stop valve 42 is improved.

According to the outdoor unit 1 for the air conditioner of the present embodiment as described above, both downsizing and improved operability of the stop valves 42 can be achieved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

1 outdoor unit
2 housing
3 heat exchanger
5 blower
5L left blower
5R right blower
11 outlet
11L left outlet
11R right outlet
15 frame
16 outer plate
21 base frame
22 pillar
25 stringer
25F front stringer
25R rear stringer
41 valve fixing frame
42 stop valve
45 pillar
46 beam
51 reinforcing rib
52 flange
53 hole
55 reinforcing rib
56 tongue-shaped piece
57 hole
61 first straight portion
62 second straight portion
65 first notch
66 second notch
67, 68 screw hole
69 convex portion
71 first stop valve
71*a* service port
71*b* indoor-unit-side connection port
71*c* outdoor-unit-side connection port
71*d* operation port
71*e* valve casing
71*f* trim portion
72 second stop valve
72*a* service port
72*b* indoor-unit-side connection port
72*c* outdoor-unit-side connection port
72*d* operation port
72*e* valve casing
72*f* trim portion
73 third stop valve
73*a* service port
73*b* indoor-unit-side connection port
73*c* outdoor-unit-side connection port
73*d* operation port
73*e* valve casing
73*f* trim portion
75, 76, 81, 82 cap
85 protrusion

The invention claimed is:

1. An outdoor unit for an air-conditioner comprising:
a base frame installed in parallel with an installation surface;
a valve fixing frame provided on the base frame; and
a plurality of stop valves fixed to the valve fixing frame, wherein:
the valve fixing frame includes a pair of pillars extending substantially vertically upward from the base frame and a beam extending across the pair of pillars to support the plurality of stop valves;
the beam includes a first straight portion that has a first notch being opened upward and a second notch being opened downward, wherein a first stop valve included in the plurality of stop valves is disposed in the first notch, and a second stop valve included in the plurality of stop valves is disposed in the second notch;
the first stop valve and the second stop valve are different in installation height in a vertical direction with reference to the installation surface; and
the valve fixing frame further includes a protrusion provided on an edge of an open end of the second notch to support the second stop valve from below.

2. The outdoor unit for an air-conditioner according to claim 1, wherein the protrusion protrudes horizontally or obliquely upward in a situation where the outdoor unit is installed on a horizontal installation surface.

3. The outdoor unit for an air-conditioner according to claim 2, wherein the beam further includes a second straight portion that forms an obtuse angle with the first straight portion in plan view, and the second straight portion supports a third stop valve included in the plurality of stop valves.

4. The outdoor unit for an air-conditioner according to claim 1, wherein the beam further includes a second straight portion that forms an obtuse angle with the first straight portion in plan view, and the second straight portion supports a third stop valve included in the plurality of stop valves.

* * * * *